US009039226B2

(12) United States Patent
Abdullah et al.

(10) Patent No.: US 9,039,226 B2
(45) Date of Patent: May 26, 2015

(54) DESK ORGANIZER AND MULTI-COMPARTMENT STORAGE UNIT

(71) Applicant: Adel M. A. Abdullah, Safat (KW)

(72) Inventors: Adel M. A. Abdullah, Rumaithya (KW); Kevin Dahlquist, Charlotte, NC (US); Tom James Philpott, Charlotte, NC (US); Ryan Shane Gorman, Charlotte, NC (US); Daniel Lee Bizzell, Charlotte, NC (US); Juan Carlos Perez, Charlotte, NC (US)

(73) Assignee: Adel M. A. Abdullah, Safat (KW)

( * ) Notice: Subject to any disclaimer, the term of this patent is extended or adjusted under 35 U.S.C. 154(b) by 230 days.

(21) Appl. No.: 13/832,646

(22) Filed: Mar. 15, 2013

(65) Prior Publication Data

US 2014/0268690 A1 Sep. 18, 2014

(51) Int. Cl.

| | |
|---|---|
| ***A47B 49/00*** | (2006.01) |
| ***A47B 96/04*** | (2006.01) |
| ***F21V 33/00*** | (2006.01) |
| ***B43M 99/00*** | (2010.01) |
| ***B43K 23/00*** | (2006.01) |

(52) U.S. Cl.

CPC ..... *B43M 99/009* (2013.01); *F21V 33/0048* (2013.01); *A47B 49/004* (2013.01); *B43K 23/001* (2013.01); *B43M 99/00* (2013.01); *B43M 99/008* (2013.01)

(58) Field of Classification Search

CPC . F21V 33/001; F21V 33/0012; F21V 33/002; F21V 33/0024; F21V 33/0048; B43M 99/00; B43M 99/008; B43M 99/009; B43K 23/001; A47B 49/004; A47B 96/04

USPC ..... 362/127, 132, 133, 134, 154, 183, 234, 362/253; 211/10, 11, 26, 26.2, 95, 119.005, 211/144, 163; 439/13, 28; 312/249.2, 312/249.3, 249.4, 285, 125, 135, 305; 206/214, 224, 320, 371, 576; 361/608, 361/679.56; 144/28.1–28.9; 30/453, 454, 30/455; 108/22, 103, 139

See application file for complete search history.

(56) References Cited

U.S. PATENT DOCUMENTS

| | | | | |
|---|---|---|---|---|
| 1,029,709 | A * | 6/1912 | Norrlander | 312/249.4 |
| 2,574,164 | A * | 11/1951 | Baay | 362/127 |
| 2,879,507 | A * | 3/1959 | Bonistall | 343/721 |
| 4,850,658 | A | 7/1989 | Sandor | |
| 5,351,173 | A * | 9/1994 | Byrne | 362/127 |
| 5,558,417 | A | 9/1996 | Termotto | |
| 6,132,054 | A * | 10/2000 | Rogers et al. | 362/86 |
| 6,279,753 | B1 * | 8/2001 | Swanson | 211/13.1 |
| 6,425,647 | B1 | 7/2002 | Pothin | |
| 6,457,498 | B1 * | 10/2002 | Salus et al. | 144/28.1 |
| 6,588,609 | B1 * | 7/2003 | Richet et al. | 211/163 |

(Continued)

*Primary Examiner* — Alan Cariaso

(74) *Attorney, Agent, or Firm* — Lowe Hauptman & Ham, LLP

(57) ABSTRACT

An annular shaped two tier desk organizer and multi-compartment storage unit or device. The organizer/storage unit includes a base assembly having a central vertical axis, a stationary lower member and a rotatable upper member superposed or superimposed on the lower member. The lower member includes a speaker, an electric pencil sharpener, an electric stapler and a USB port for charging a cell phone, calculator or the like. A small computer is also disposed in the lower member and is connected to the Internet.

9 Claims, 5 Drawing Sheets

(56) References Cited

U.S. PATENT DOCUMENTS

| | | | | |
|---|---|---|---|---|
| 7,001,003 | B1 | 2/2006 | Stone | |
| 7,275,956 | B1 | 10/2007 | Montesano | |
| 7,642,912 | B2 * | 1/2010 | Sholem | 340/539.32 |
| 7,758,202 | B2 * | 7/2010 | Krieger | 362/131 |
| 8,220,645 | B2 | 7/2012 | Robinson | |
| 8,636,016 | B1 * | 1/2014 | Lee | 132/286 |
| 2006/0209530 | A1 * | 9/2006 | Schaak | 362/86 |
| 2012/0181907 | A1 * | 7/2012 | Edwards et al. | 312/249.4 |

* cited by examiner

DESK ORGANIZER AND MULTI-COMPARTMENT STORAGE UNIT

FIELD OF THE INVENTION

This invention relates to a desk organizer and multi-compartment storage unit and more particularly to an annular shaped device with a lower stationary tier and an upper rotatable tier or member that is rotatable about a central vertical axis and with respect to the stationary lower tier or member.

BACKGROUND OF THE INVENTION

Multi-compartment containers are well known and have been frequently used for pills, candy, screws, bolts and other hardware supplies. For example, a capsule or pill dispenser is disclosed in a U.S. Pat. No. 3,926,335 of Dangles et al. that includes upper and lower pill storage tiers each having twelve radial pill storage compartments. As disclosed, each tier is covered by a rotatable dial having a generally horizontal opening for pill insertion and a vertical opening for pill discharges. A similar pill container is disclosed in a U.S. Pat. No. 5,782,359 of McAllister et al. As disclosed therein, the container includes a plurality of compartments and a lid in which compartments cannot be opened when the lid is in a closed position. The '359 patent discloses a plurality of trapezoidal shaped compartments disposed around a circular opening to form a polygonal shaped container. The trapezoidal shaped cover lid opens outwardly.

A detachable stationary case rack is disclosed in a U.S. patent of Huang et al., U.S. Pat. No. 4,953,696. As shown, the case rack has a polygonal bottom case divided into several compartments forming a hollow central shaft. The base of the rack has a packing set therein, which packing includes several round balls to permit rotation of the whole assembly against the base.

A more recent U.S. patent in the name of the present inventor U.S. Pat. No. 7,878,337 discloses a rotatable two-tier multi-compartment container. The container includes an outer wall, an inner wall and a plurality of radially extending divider walls extending between the inner and outer walls to form a plurality of trapezoidal shaped adjacent chambers. The container also includes a plurality of trapezoidal shaped upper chambers opening outwardly away from the inner chamber and a plurality of trapezoidal shaped covers for covering the upper chambers.

Notwithstanding the above, it is presently believed that will be a commercial market for a desk organizer and multi-compartment storage unit in accordance with the present invention. There should be a commercial market for the desk organizer and storage unit because they are compact, store a number of office supplies and are durable and provide immediate access to stationary items. In addition, such units have a pleasing appearance.

BRIEF SUMMARY OF THE INVENTION

In essence, the present invention comprises and/or consists of a desk organizer and multi-compartment storage unit for a plurality of articles such as paper clips, staples, file stickers, Post its etc. The desk organizer/storage unit comprises or consists of a base assembly having a horizontal surface for positioning the organizer/storage unit on a desk or credenza or a table. The desk organizer and storage unit comprises or consists of a circular shaped rotatable upper member that is rotatable about the central axis and about a circular shaped stationary lower member. The upper member is superposed or superimposed on the lower member and rotated about the central axis and with respect to the lower member.

The desk organizer and storage unit also comprises and/or consists of a source of electrical energy and means for connecting the organizer/storage unit to the source of electrical energy. A computer and means including a USB port are also disposed in the lower member together with an electric pencil sharpener and electric stapler with a removable drawer positioned under the electric pencil sharpener for receiving shavings from a sharpened point. The lower unit also includes a speaker disposed therein.

In addition to the above, the annular or preferably circular shaped upper member includes a plurality of closeable and openable separate compartments separated by a plurality of radially extending walls. The rotatable upper member includes a number of drawers that are openable from the front of the organizer/storage unit or the outer periphery of the outer wall of the rotatable member that encompasses the upper compartments. The pie-shaped compartments are openable by sliding the drawer outwardly or any other conventional manner.

A preferred embodiment of the invention includes a rechargeable battery as a source of electrical power and a solar cell for recharging the battery. The desk organizer may also include a plurality of generally downwardly extending elements, for example, six such elements that divide the organizer storage units into six pie-shaped portions. The unit is further accented with a plurality of LEDs.

The invention will now be described in connection with the accompanying drawings wherein like numerals have been used to illustrate like parts.

DESCRIPTION OF THE PREFERRED EMBODIMENTS OF THE INVENTION

Figure 1:
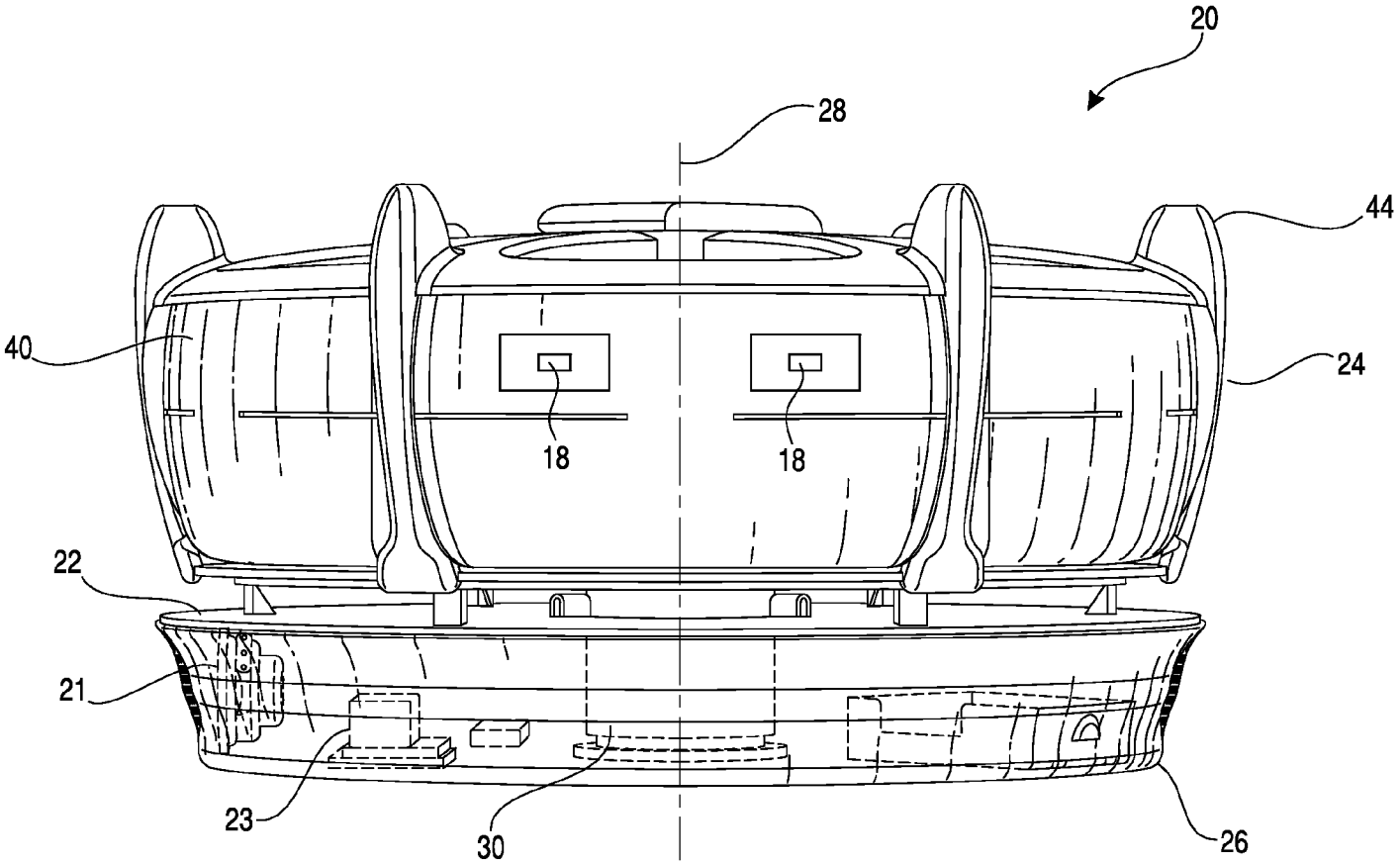
FIG. 1 is a side elevational view of a desk organizer and multi-chamber storage unit in accordance with the present invention wherein a lower portion thereof is broken away to illustrate the interior of the lower member or tier.
Figure 2:
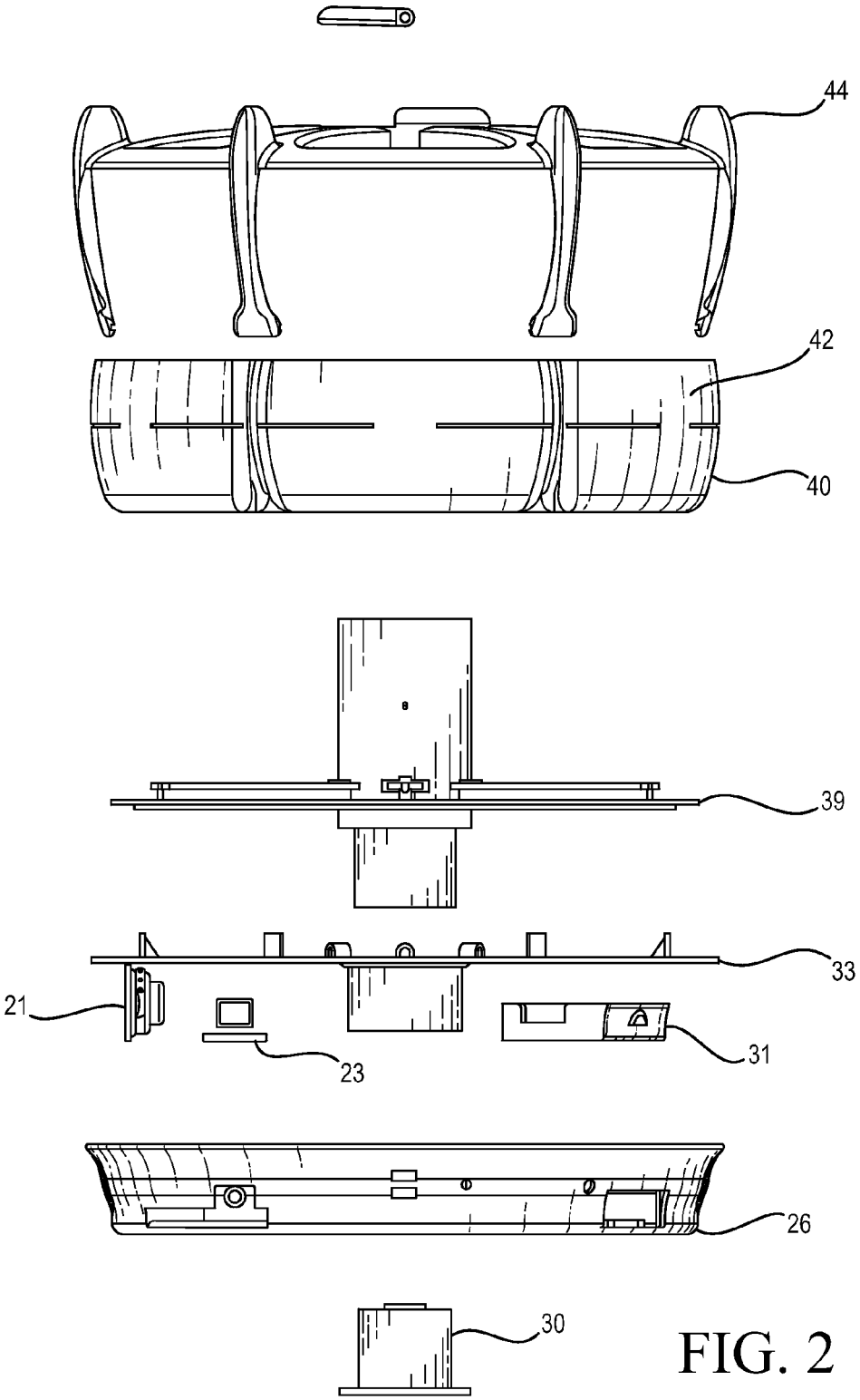
FIG. 2 is a vertical exploded side view of the desk organizer storage unit shown in FIG. 1.
Figure 3:
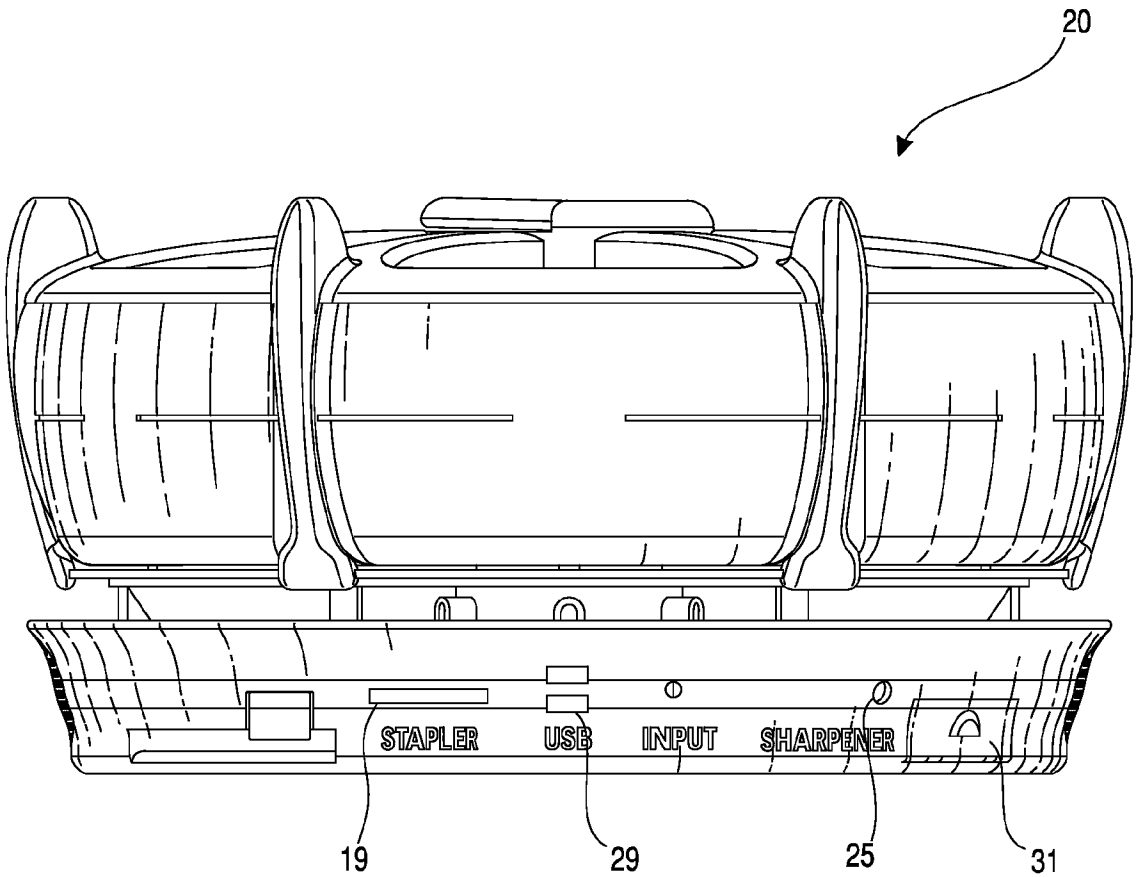
FIG. 3 is a side elevational view of the desk organizer and storage unit shown in FIG. 1 without the broken away portion in FIG. 1.
Figure 4:
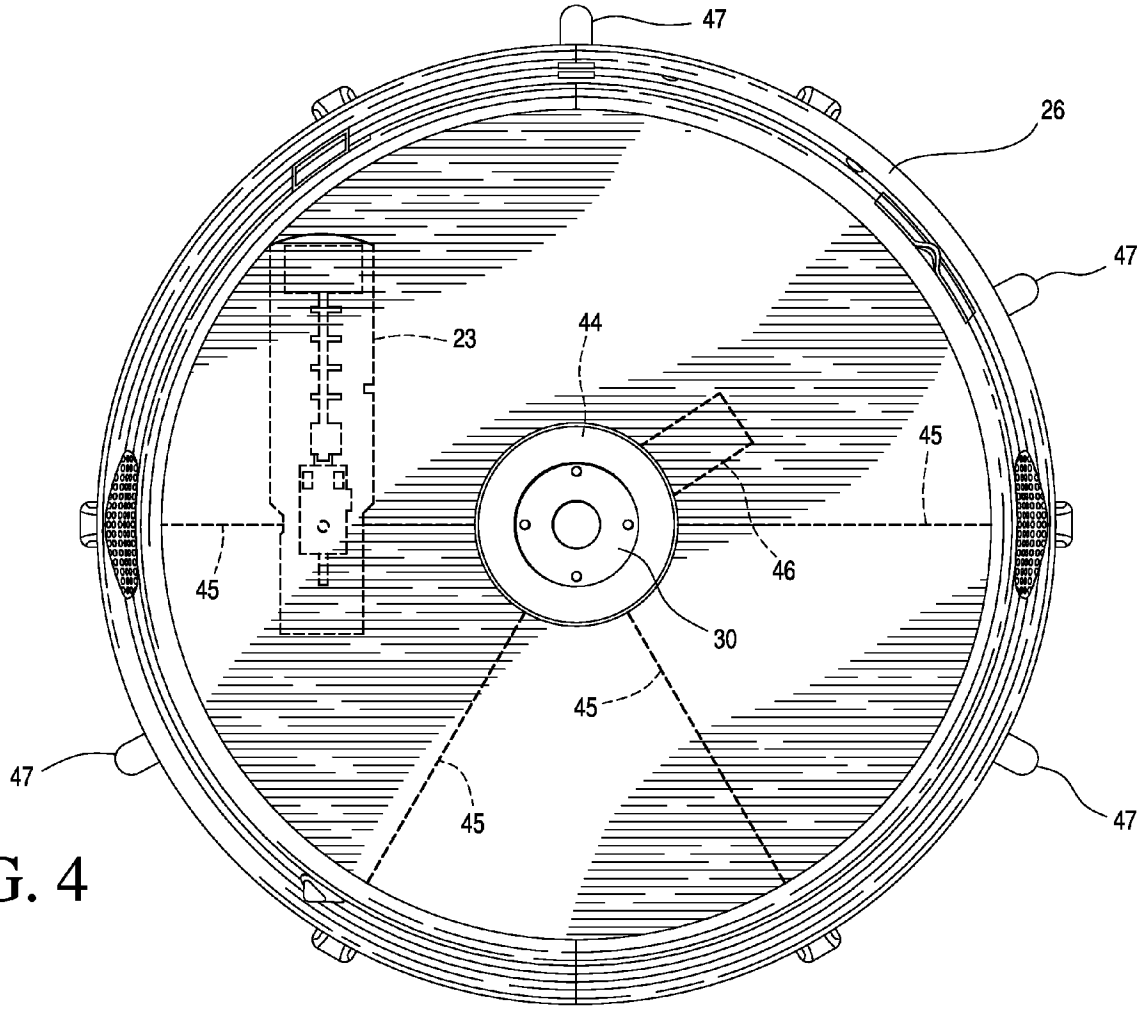
FIG. 4 is a top view of the desk organizer and storage unit shown in FIGS. 1-3 with an enlarged locking mechanism for closing the compartments in the upper tier.
Figure 5:
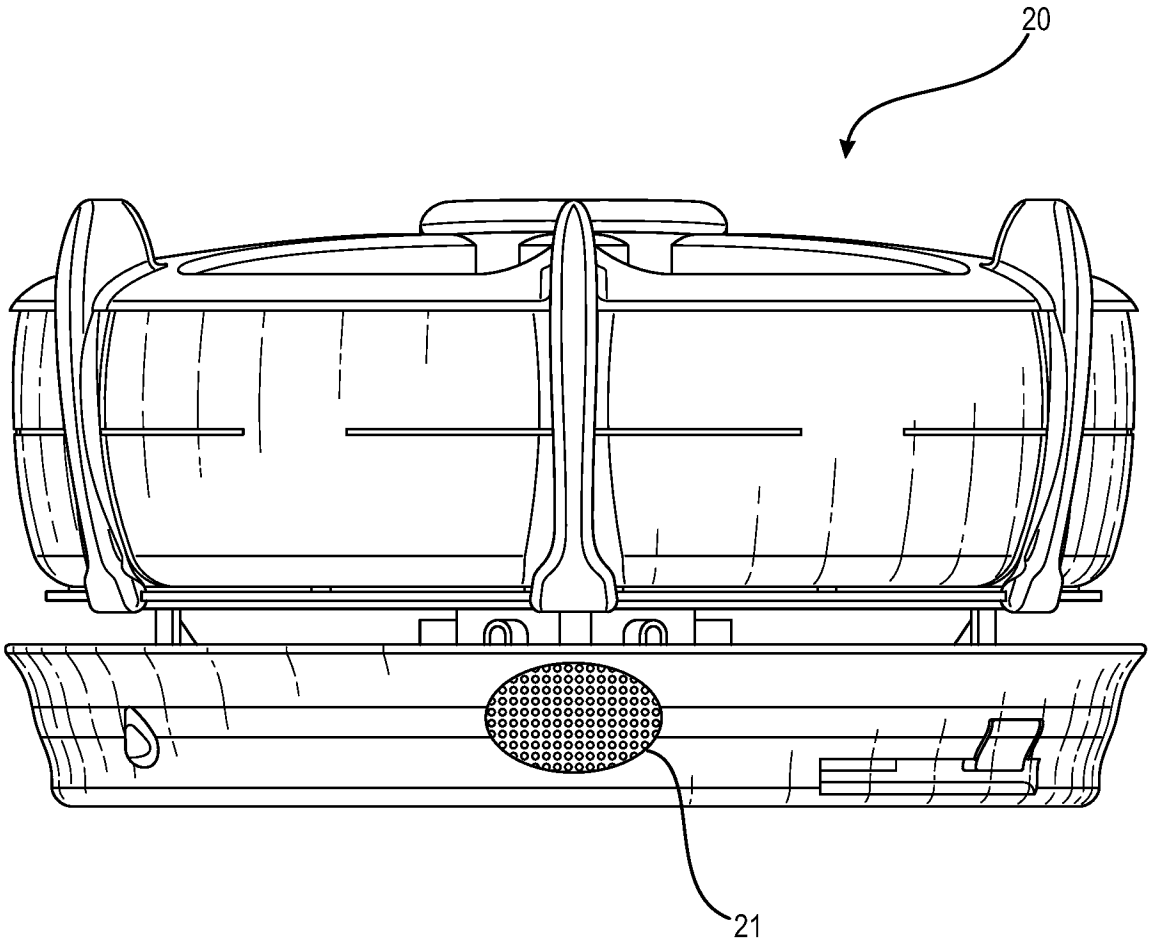
FIG. 5 is a side view of a desk organizer illustrating a pencil sharpener and USB port and accent lights.

A dual tier desk organizer and multi-compartment storage unit in accordance with the present invention will now be described in connection with FIGS. 1-5.

As illustrated in the figures, the organizer/storage unit 20 includes two tiers, a lower stationary member 22 and an upper rotational member 24 as well as a base 26 having a central vertical axis 28. The base 26 includes a lower horizontal flat portion 27 for positioning the organizer/storage unit 20 on one side of a desk or credenza (not shown).

The lower stationary member 22 is fixed to a hub 30 that forms part of the base 26 and includes a speaker 21, computer 23, electric pencil sharpener 25 and USB port 29. As illustrated, a removable drawer 31 is disposed in the lower member 22 immediately below the pencil sharpener 25 to receive the shavings from a sharpened pencil (not shown).

The lower member 22 may be keyed or otherwise fastened to the hub 30 or otherwise fixed so that the electric pencil sharpener 25 and electric stapler 19 are conveniently positioned by an individual behind a desk or in front of a credenza.

The lower member 22 includes a fixed cover or top 33 that encloses an inner chamber and prevents dust and/or dirt to enter the enclosed lower member and may include a plurality of spacers or rollers that allow a base 39 of the upper member 24 to rotate about the central axis and with respect to the lower member 22. In one embodiment of the invention the space between the upper and lower member is sufficient to accommodate a cell phone, adding machine or the like while being charged. The upper member is also enclosed by an outer wall 40 and inner wall 42 and a cover 44 that extends around and over a plurality of chambers provided in the upper member 24.

The upper member 24 rotates about a central vertical axis on a bearing and may include a drawer for each of 4 to 10 compartments in the upper member. As illustrated, the downward protruding spacers or support elements divide the upper member into 6 pie-shaped elements having one or more compartments. For example, 2 of the 6 defined spaces may include two compartments for small articles such as paper clips or erasers or the like marked with identifiers 18. The outer diameter is presently believed to be between about 30 to about 36 inches in diameter and about 24 to about 30 inches in height.

In the preferred embodiment of the invention the organizer/storage unit has a generally circular or circular cross section and an outer diameter of about 24 to 36 inches. In this embodiment, the source of electrical energy is a rechargeable battery 46 and the unit includes a centrally disposed solar cell 44 for recharging the battery 46. The preferred unit also includes 6 to 8 compartments in the upper tier that are separated by a plurality of radially extended walls 45 and each chamber includes a pop-out drawer for containing a plurality of office supplies or articles. In addition, the unit includes a plurality of LED lights 47 and the previously mentioned compartments are for pencils, clips, staples, stickers, glue, scissors, pocket change and business cards.

A further addition to the overall unit is a place, as for example a space between the tiers, for positioning a cell phone for charging in the unit.

While the invention has been described in connection with the accompanying drawings it should be recognized that changes and modifications may be made therein without departing from the scope of the appended claims.

What is claimed is:

1. A desk organizer and multi-compartment storage unit comprising:

a base assembly having a central axis for positioning said organizer/storage unit on a horizontal surface, an annular shaped stationary lower member including a central axis, and an annular shaped rotatable upper member superposed or superimposed on said lower member and rotatable about said central axis and with respect to said lower member;

a source of electrical energy connecting said organizer and storage unit to said source of electrical energy;

a computer and means including a USB port disposed in said lower member, an electric pencil sharpener and electric stapler disposed in said lower member with a removable drawer positioned under said electric pencil sharpener for receiving shavings from a sharpened point, the speaker and said computer disposed in said lower member; and said annular shaped upper member including a plurality of closable and openable separate compartments for storing a plurality of articles.

2. A desk organizer and multi-compartment storage unit according to claim 1, in which said annular shaped upper and lower members have a generally circular shape.

3. A desk organizer and multi-compartment storage unit according to claim 2, in which said source of electrical energy is a battery.

4. A desk organizer and multi-compartment storage unit according to claim 3, in which said battery is a rechargeable battery and in which said organizer and storage unit includes a solar cell for recharging said battery.

5. A desk organizer and multi-compartment storage unit according to claim 4, in which said circular shaped rotatable upper member is separated into the plurality of openable and closable compartments by a plurality of radially extending walls.

6. A desk organizer and multi-compartment storage unit according to claim 5, which includes six downwardly projecting elements that extend from above said upper member to a bottom of said upper member.

7. A desk organizer and multi-compartment storage unit according to claim 1, which includes a plurality of LED accent lights.

8. A desk organizer and multi-compartment storage unit according to claim 7, which includes separate storage compartments for markers, clips, staples, stickers, glue, scissors, pocket change and business cards and in which said compartments are marked with identifiers.

9. A desk organizer and multi-compartment storage unit consisting of:

a base assembly having a vertical central axis for positioning said organizer and storage unit on a horizontal surface, a circular shaped stationary lower member disposed about said central axis and a circular shaped upper member superimposed on said circular shaped lower member and rotatable about said central axis and with respect to said lower member;

a rechargeable battery, a solar cell for recharging said battery, connecting said battery and said solar cell and said battery and said organizer and storage unit;

a computer and means including a USB port disposed in said lower member, an electric pencil sharpener and electric stapler disposed in said lower member and a removable drawer positioned under said electric pencil sharpener for receiving shavings from a sharpened point, a speaker and said computer disposed in said lower member; and said circular shaped upper member including 6 to 8 closable and openable separate compartments separated by a plurality of radially extending walls for storing a plurality of office supplies; and said organizer and storage unit including a separated cover over said upper member for opening and closing said compartments in said upper member and further including a plurality of LED accent lights and six downwardly projecting elements from above said upper member to a bottom of said upper member.

* * * * *